United States Patent [19]

Omote

[11] 3,990,383

[45] Nov. 9, 1976

[54] CARGO LOADING AND UNLOADING APPARATUS FOR A VESSEL

[75] Inventor: Sadao Omote, Tokyo, Japan

[73] Assignee: Nissei Shipping Co., Ltd., Tokyo, Japan

[22] Filed: June 9, 1975

[21] Appl. No.: 584,890

[30] Foreign Application Priority Data

June 17, 1974 Japan ..... 49-68965

[52] U.S. Cl. ..... 114/85; 114/72

[51] Int. Cl.[2] ..... B63B 3/48

[58] Field of Search ..... 114/72, 73, 85; 187/25

[56] References Cited

UNITED STATES PATENTS

| | | | |
|---|---|---|---|
| 3,019,757 | 2/1962 | Bailey | 114/72 |
| 3,109,402 | 11/1963 | Blomberg et al. | 114/72 |
| 3,474,925 | 10/1969 | McCartney et al. | 187/25 |
| 3,624,736 | 11/1971 | Jwami | 114/72 |

FOREIGN PATENTS OR APPLICATIONS

| | | | |
|---|---|---|---|
| 1,099,384 | 2/1961 | Germany | 114/72 |

*Primary Examiner*—Trygve M. Blix
*Assistant Examiner*—Sherman D. Basinger
*Attorney, Agent, or Firm*—Wenderoth, Lind & Ponack

[57] ABSTRACT

A cargo loading apparatus for a cargo vessel having a multi-story construction with a plurality of holds each defined by the adjacent decks of the cargo vessel, there being at least one partition separating each of the holds into a plurality of hold sections, selected ones of the hold sections being arranged so that the deck sections corresponding to the selected hold sections are vertically movable; and lifting apparatus to move the corresponding movable deck sections upwardly and downwardly.

6 Claims, 25 Drawing Figures

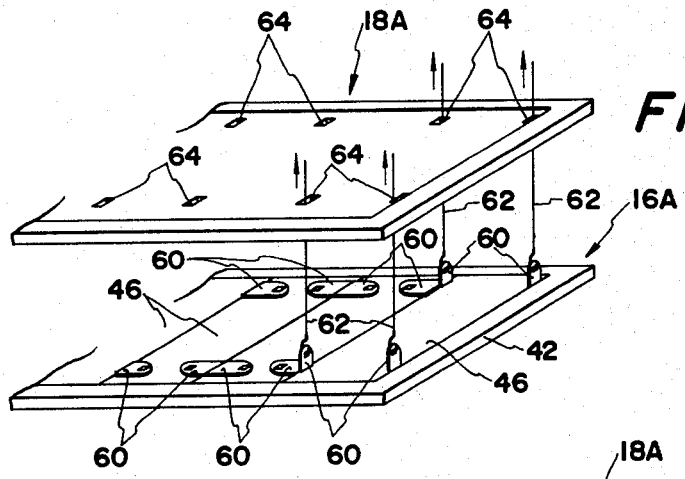
FIG. 13
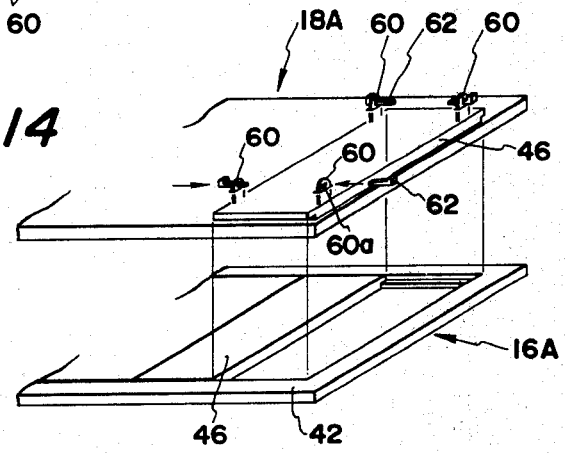
FIG. 14
FIG. 15A
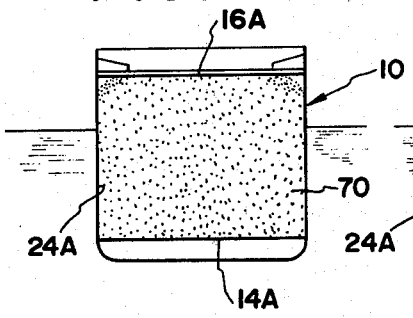
FIG. 15B
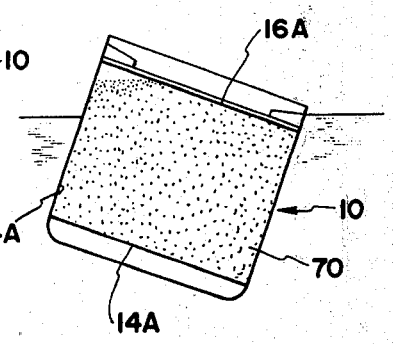

CARGO LOADING AND UNLOADING APPARATUS FOR A VESSEL

FIELD OF THE INVENTION

This invention generally relates to a cargo loading apparatus for a cargo vessel having a multi-story construction and suitable for carrying weighty cargoes such as cars, steel materials, cereals, ores and the likes.

BACKGROUND OF THE INVENTION

Conventionally, there have been exclusively used the cargo vessels which are adapted to the configurations, weights and properties of the cargoes to be carried. Thus, since one cargo vessel has been unable to carry all the kinds of cargoes, many kind of cargo vessel must be constructed corresponding to the application.

In general, a cargo vessel has a multi-story construction. In some of the vessels, each of the decks is stationary and in other cargo vessels, it is wholly vertically movable so that it must be adjusted in height based on the greatest height of the cargoes to be received in the corresponding hold. A disadvantage of such cargo vessels is that if the hold receives various cargoes different in height, the vacant or dead space will exist above the lower cargoes to cause deterioration of the loading capacity.

In case a cereal carrying vessel receives and carries cereals, they cause the vessel to be out of balance during its voyage due to their movement toward the lower side of the vessel when it tilts on the wave. An ore vessel must be provided at both sides with large ballast tanks to prevent the vessel from being out of balance, which causes deterioration of the loading capacity.

SUMMARY OF THE INVENTION

Accordingly, it is a principal object of the present invention to provide a cargo loading apparatus for a cargo vessel which is adapted to load and carry, various cargoes in one vessel.

It is another object of the present invention to provide a cargo loading apparatus for a cargo vessel which is adapted to load cargoes with higher loading capacity.

It is further object of the present invention to provide a cargo loading apparatus for a cargo vessel which is adapted to keep the condition of the cargo more stable during its voyage.

It is further object of the present invention to provide a cargo loading apparatus for a cargo vessel which is adapted to load cargoes in a more effective manner.

In accordance with the present invention, there is provided a cargo loading apparatus for a cargo vessel having a multi-story construction with a plurality of holds each defined by the adjacent decks of said cargo, vessel, comprising at least one partition partitioning each of said holds into a plurality of hold sections, selected one of said hold sections being constructed so that the deck sections corresponding to said selected hold sections are vertically movable; and lifter means to move each of the corresponding ones of said movable deck sections upwardly and downwardly.

BRIEF DESCRIPTION OF THE DRAWINGS

The above and other object and features of the present invention will be apparent from the description of preferred embodiments taken with reference to the accompanying drawings in which;

FIGS. 13 and 14 perspectively show how the third deck section is secured to the fourth deck;

FIGS. 15A and 15B show in cross section how one hold section may be loaded with grain in a stable manner;

DETAILED DESCRIPTION OF PREFERRED EMBODIMENTS OF THE INVENTION

Figure 1:
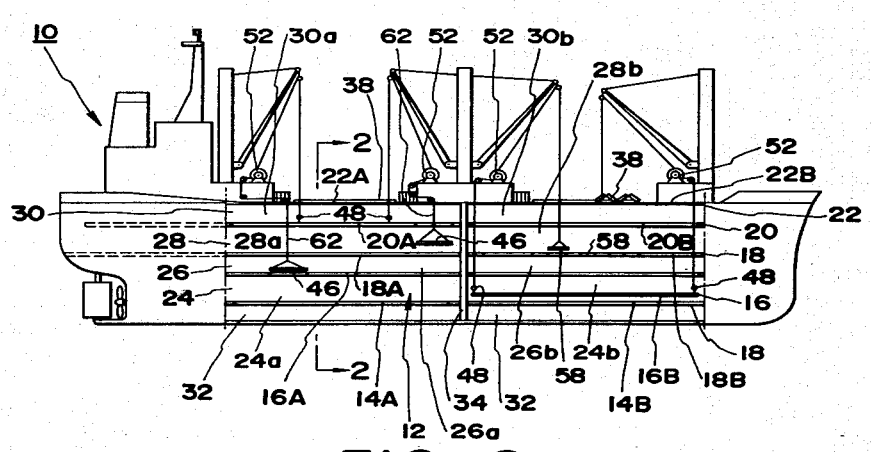
FIG. 1 is a side elevational view of a cargo vessel employing a cargo loading apparatus of the present invention with the vessel broken away for a purpose of illustrating the interior of the vessel.

Referring now to FIG. 1, there is shown a cargo vessel indicated generally at numeral 10 and in which a cargo loading apparatus indicated generally at numeral 12 is used. The cargo vessel 10 may be provided with a first or lowermost, second, third, fourth and fifth or uppermost decks 14, 16, 18, 20 and 22 which constitute the multi-story construction having a plurality of holds 24, 26, 28 and 30 each defined by the adjacent decks. The vessel may be also provided at the lowermost with a ballast tank 32 which serves to receive gravel, water or any other liquid such as fuel oil to balance it on its voyage. The multi-storied holds 24 to 30 are partitioned by a bulk head 34 into the front hold sections **24*a* to 30*a* and the rear hold sections 24*b* to 30*b*. Alternatively, they may be partitioned into more than two hold sections. In FIG. 1, numerals 14*a* to 22*a* and 14*b* to 22*b* designate front and rear deck sections formed by the bulk head 34, respectively. It will be noted that the ballast tank 32** may be partitioned by the bulk head.

Figure 6A:
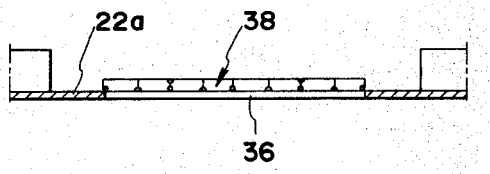
FIGS. 6A to 6C show the uppermost deck section in respective different conditions.
Figure 6B:
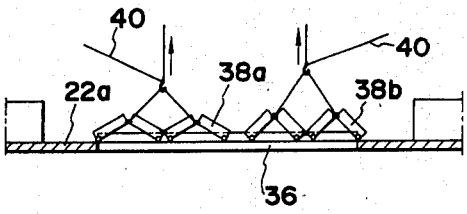
Figure 6C:
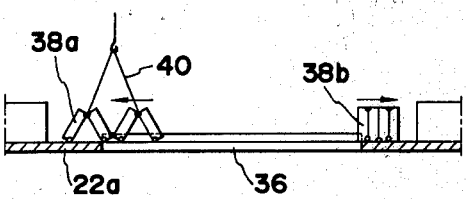
Figure 7:
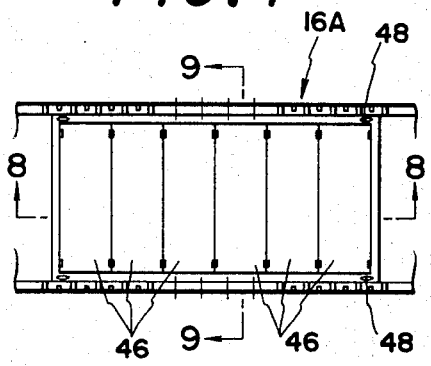
FIG. 7 is a top view of the second deck section.

One of the uppermost deck sections referenced to at numeral **22*a* is shown in FIG. 3 and FIGS. 6A to 6C in more detail and is provided with a hatch 36 through which cargoes are to be received into and removed from the hold sections 24*a* to 30*a*. It will be understood that the other uppermost deck section 22*b* is also provided with a hatch as shown in FIGS. 6A to 6C. A hatch cover 38 which closes and opens the hatch 36 may comprise rectangular cover members 38***a* and 38*b* hinged to one another of the adjacent members and the members may be opened by wires 40 which are pulled by a winch not shown, as shown in FIGS. 6B and 6C.

Figure 4:
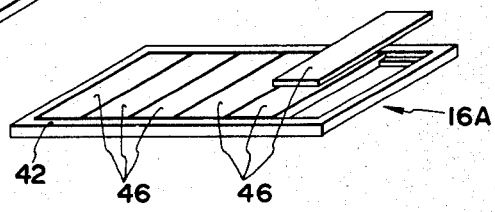
FIG. 4 is an enlarged perspective view of one of the fourth deck sections.
Figure 10:
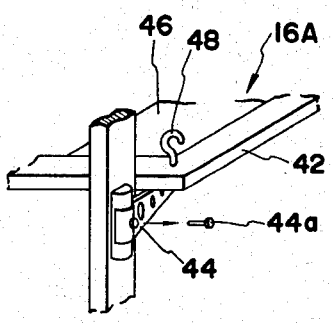
FIGS. 10 and 11 perspectively show a corner of the second deck section when it is to be lowered.
Figure 8:
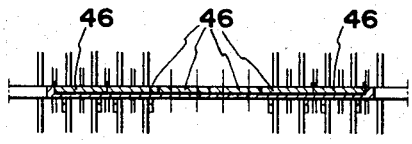
FIG. 8 is a sectional view of the second deck section taken along the line 8—8 of FIG. 7.
Figure 11:
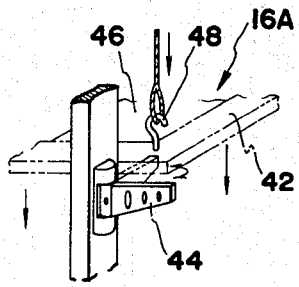
Figure 9:
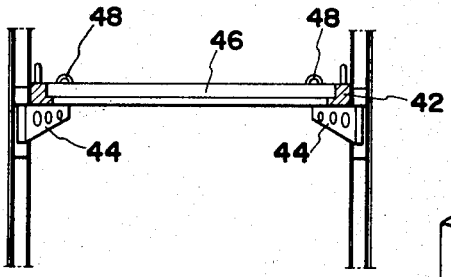
FIG. 9 is a sectional view of the second deck section taken along the line 9—9 of FIG. 7.
Figure 12:
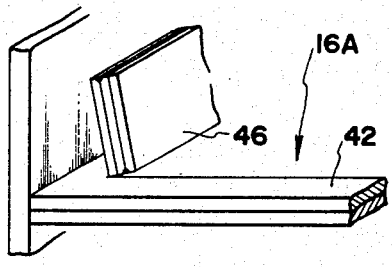
FIG. 12 perspectively shows a portion of the second deck section when it is to be opened.

The second and fourth deck sections 16*a*, 20*a* and 16*b*, 20*b* may be identical in construction and one of the deck sections referred to at numeral 16*a* is shown in FIG. 4 in more detail. The deck section 16*a* may comprise a rectangular frame 42 at the corners mounted on movable brackets 44 which are in turn pivoted on the side walls of the vessel as shown in FIGS. 9, 10 and 11, and a plurality of deck plate members 46 mounted and arranged on the frame 42 side by side as shown in FIG. 4, 5, 7 and 8. Suspending hooks 48 are secured to the frame 42 at the corners thereof as shown in FIG. 1, 10 and 11. As shown in FIGS. 10 and 11, the deck section 16A can be suspended by wires 50 which are in turn hooked by the hooks 48 and lowered or raised up by winches 52 provided on the vessel 10 as shown in FIG. 1. In order to allow the second deck section 16A to be lowered, the movable brackets 44 can be retracted from the path of the deck section when the corresponding pins 44*a* are removed from the respective brackets as shown in FIGS. 10 and 11. The similar components of other second deck section 16B and the fourth deck sections 20A and 20B are designated by the same numerals.

Figure 2:
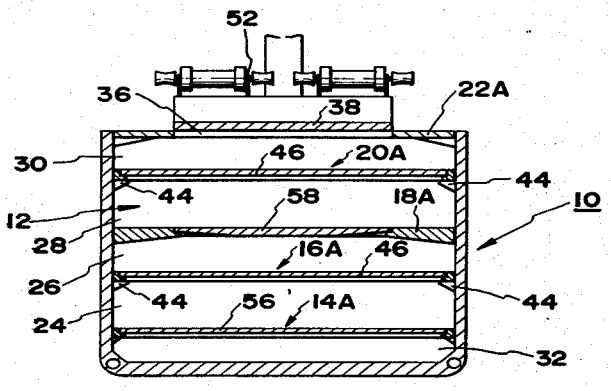
FIG. 2 is a cross sectional view of the cargo vessel taken along the line 2—2 of FIG. 1.
Figure 3:
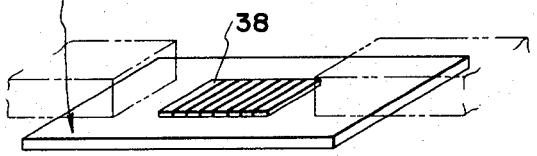
FIG. 3 is an enlarged perspective view of one of the uppermost deck sections.

The first deck sections 14A and 14B may each comprise a rectangular frame 54 secured to the side walls of the vessel 10 and a plurality of deck plate members 56 mounted on the frame 54 side by side as shown in FIG. 2. The ballast tank 32 may be filled with ballast through the opening of the first deck sections which results from removal of the deck plate members 56 from the frame 54.

Figure 5:
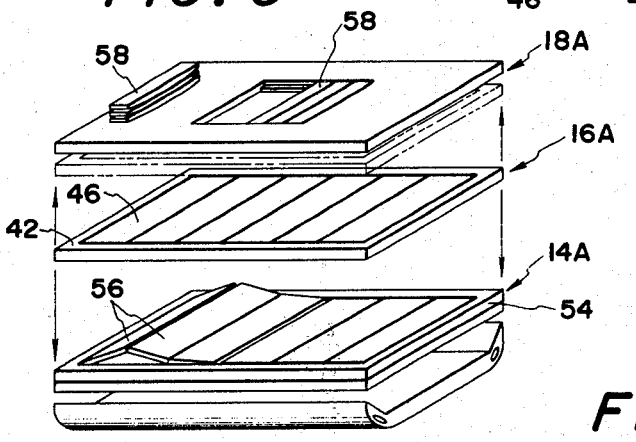
FIG. 5 perspectively and schematically shows the first, second and third deck sections arranged in an actual manner.

The third deck sections 18A and 18B may be also stationary and may comprise hatches 58 which includes a plurality of plate members to be removed in order to partially open them for a purpose of loading and unloading cargoes, as shown in FIG. 5.

The deck plate members 46 of the second deck sections 16A may each be preferably provided at the corners with collapsible ears 60 (FIG. 13) which are in turn suspended by wires 62 to be pulled by the winches 52 as shown in FIGS. 1 and 13. The wires 62 may extend through holes 64 provided in the deck section 18A in alignment with the ears 60. Thus, the deck plate members 46 may be individually adjusted in height as described in more detail with reference to FIGS. 16A to 16C. Any of the deck plate members 46 may be secured to the corresponding deck portion as shown in FIG. 14. The ears 60 may extend through the corresponding holes 64 in the deck section 18A and pins 62 may extend through the holes 60a in the ears 60, respectively so that the deck plate member or members 46 can be secured to the portion or portions of the deck section 18A. It will be understood that the deck plate members 46 of the fourth deck sections 20A and/or the second and fourth deck sections 18B and 20B may be also individually adjusted in height or secured to the just upside deck sections in the same manner.

Although in the illustrated embodiment the second and fourth deck sections 16A, 16B and 20A, 20B may be vertically movable, it will be understood that any selected deck sections may be movable corresponding to the number of the stories of the deck in the vessel.

Although in the illustrated embodiment the wire-winch mechanism may drive the deck sections and/or the deck plate members thereof to move upwardly and downwardly, it will be appreciated that any other mechanism such as a hydraulic cylinder mechansm or the like may drive them alternately.

FIG. 15 shows how the cargo vessel may be loaded with grains 70. As shown in this figure, the lowermost hold section 24A may be filled with the grains and the just upside deck section 16A may be lowered until it engages the grains at the uppermost level thereof. With this arrangement, the grains may be restrained from their movement toward the lower side of the vessel 10 although it tilts on the wave during its voyage. Thus, the cargo vessel can make a voyage in a stable manner without loss of balance due to the movement of the grains toward the one side of the vessel. Besides, the lowered second deck section 16A may have cargoes mounted thereon.

Figure 16A:
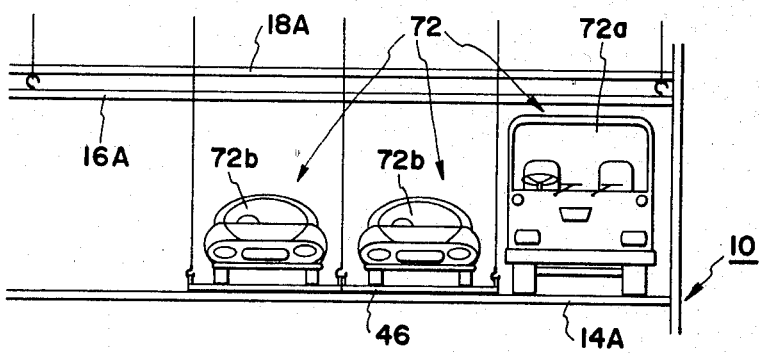
FIGS. 16A to 16C show how one hold section may be loaded with cars in an effective manner.
Figure 16B:
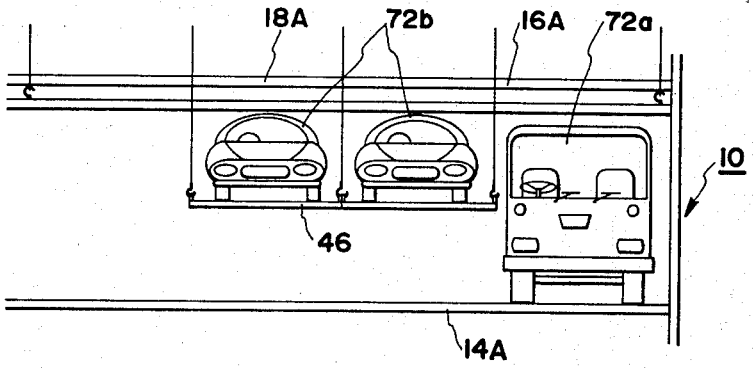
Figure 16C:
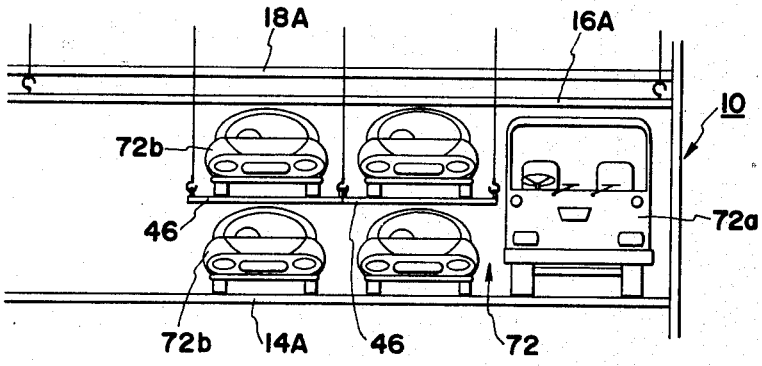

FIGS. 16A to 16C show how the cargo vessel 10 may be loaded with cars 72. As shown in these figures, after the second deck section 16A is raised up toward the third deck section 18A, the higher car 72*a* may be mounted on the first deck section 14A at the end and the lower cars 72*b* may be mounted on some of the deck plate members 46 lowered to the middle level of the higher car 72*a* while the other lower cars may be mounted on that portion of the deck section adjacent to the higher car, which is shown in FIG. 16C. Thus, the dead spaces do not exist within the hold section 24.

Figure 17:
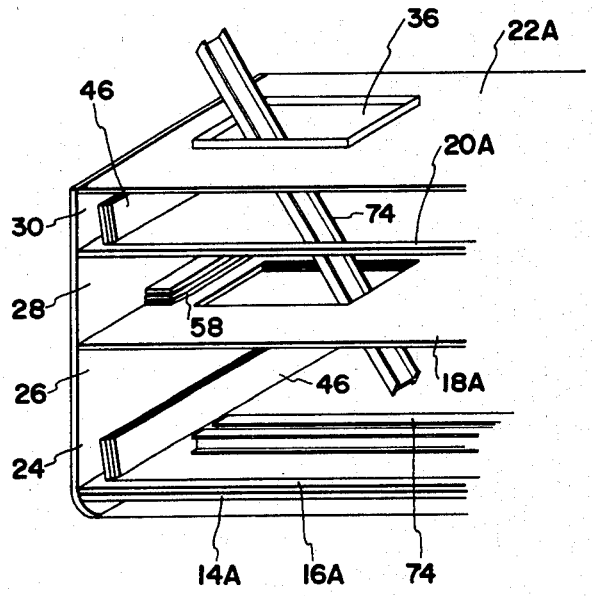
FIG. 17 shows how the first hold section may be loaded with steel materials.

FIG. 17 shows how the cargo vessel 10 may be loaded with elongate steel materials 74. In this case, after the second deck section 16A is lowered to engage the lowermost deck section 14A and then the deck plate members 46 are removed from the frame to open the deck section 16A so that a larger hold section is formed including the hold sections 24, and 26, the elongate steel materials 74 successively pass through the open hatch 36 and then through the openings of the deck sections 20*a* and 18A and are received in the hold sections 24 and 26. Of course, it will be understood that they may be mounted on the third deck section 18A in the same manner.

Figure 20:
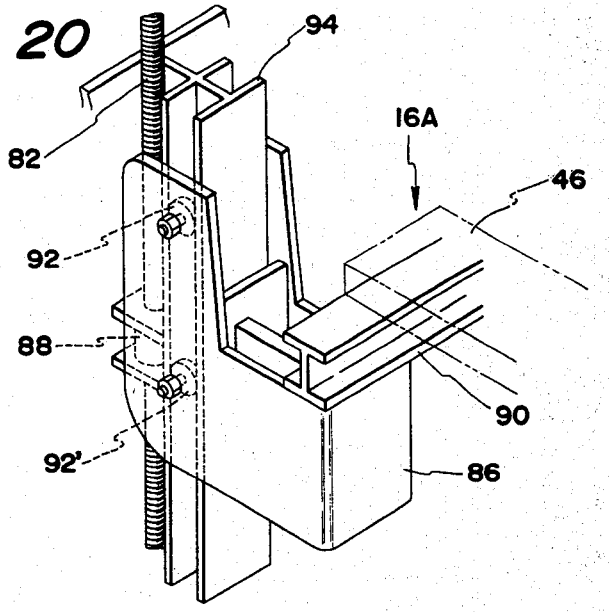
FIG. 20 is a perspective view of a portion of the lifter means of FIG. 18.
Figure 18:
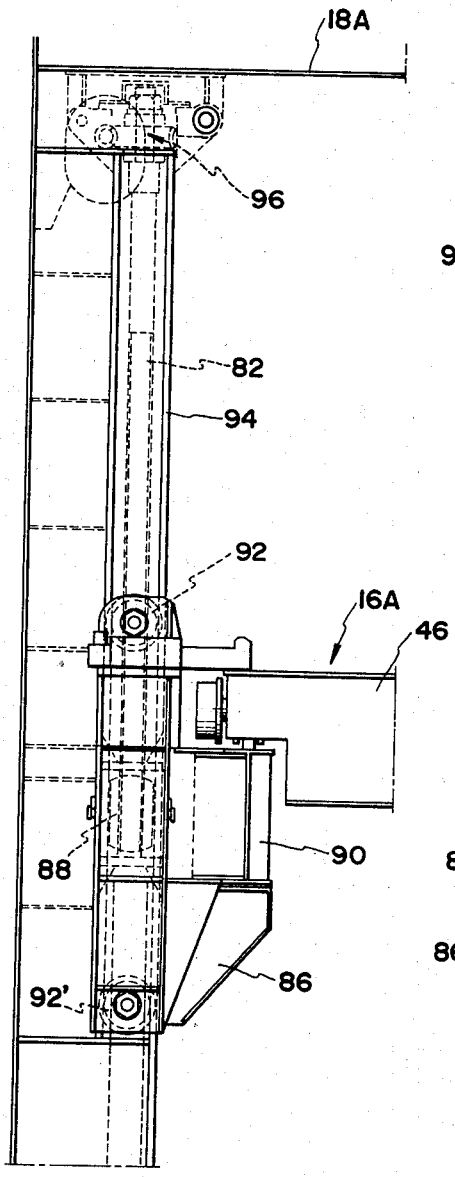
FIG. 18 is a schematic front view of another embodiment of lifter means used in the present invention.
Figure 19:
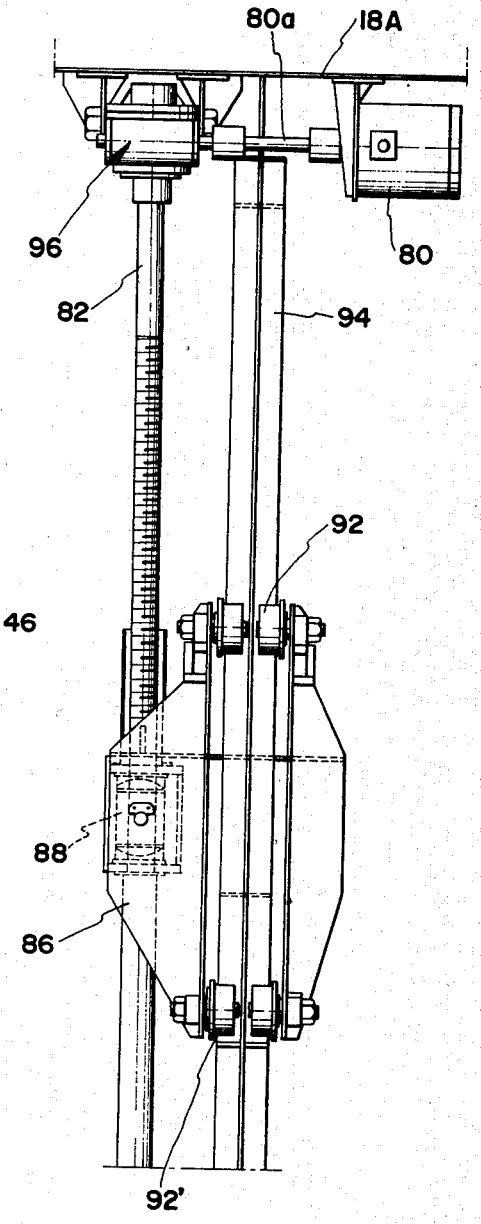
FIG. 19 is a side view of the lifter means of FIG. 18.

Referring now to FIGS. 18 to 20, there is shown an alternative embodiment of lifter means to upwardly and downwardly move the movable deck sections 16A. This lifter means may comprise an electric motor 80 mounted on the just upper deck section 18A, a threaded rod 82 disposed in a vertical manner and journalled on a bearing 84 mounted on the deck section 18A, and a frame 86 having a internally threaded ring 88 secured thereto and threadedly engaged with the threaded rod 82. One of the deck plate members 46 may be supported on the frame 86 through a supporting member 90 of the I-shaped steel. The frame 86 is also provided with a pair of rollers 92 and 92' which in turn may engage a guide member 94 of I-shape vertically disposed in a parallel manner to the threaded rod 82 and secured to the deck section 18A. Thus, on rotational movement of the threaded rod 82, the frame 86 and the deck plate member 46 can upwardly or downwardly move in a smooth manner while it is guided by the guide members 94. In FIGS. 18 and 19, numerals 96 designate a worm gearing to connect the output shaft 80*a* of the electric motor 80 with the threaded rod 82. It will be noted that the other deck plate members 46 of the second deck section 16A may be driven by the similar lifter means. Also, it will be noted that the frames 42 of the second deck section 16A may be driven by the similar lifter means. Of course, the other second deck section 16B and the fourth deck sections 20A and 20B may have the same mechanism as described in connection with FIGS. 18 to 20.

While some preferred embodiments of the present invention have been illustrated and described with reference to the accompanying drawings, it will be apparent to those skilled in the art that various modifications and changes may be made without departing from the spirit and scope of the present invention, which is intended to be defined only by the appended claims.

What is claimed is:

1. A cargo loading apparatus for a cargo vessel having a plurality of superposed holds separated by permanent decks, said apparatus comprising at least one partition partitioning each of said holds into a plurality of hold sections, a rectangular frame in at least one of said sections substantially filling said section and having the sides adjacent the hull of the vessel and said partition, a plurality of deck plate members removably mounted in side by side positions in said frame so as to completely fill the frame, means in said cargo vessel connected to said frame for supporting said frame at any vertical position in said hold section and for moving said frame vertically in said hold section, and further means in said cargo vessel connected to the respective deck plate members for supporting said deck plate members at any vertical position in said hold section other than in said frame and for moving said deck plate members vertically in said hold section independently of said frame.

2. A cargo loading apparatus as set forth in claim 1 wherein said means for supporting and vertically moving said frame comprises wires attached to the corner portions of said frame and winch means on which said wires are windable for raising and lowering said frame member.

3. A cargo loading apparatus as set forth in claim 2 in which said means for supporting and vertically moving said frame comprises pivotable brackets on said vessel pivotable from a position beneath said frame for supporting said frame to a position out of the way of said frame.

4. A cargo loading apparatus as set forth in claim 1 in which said further means for supporting said deck plate members and moving said deck plate members vertically comprises wires attached to the corner portions of said plate members and winch means on which said wires are windable for raising and lowering said deck plate members and supporting the raised deck plate members in a position raised out of the frame.

5. A cargo loading apparatus as set forth in claim 4 wherein said deck plate members each having ears pivotally mounted at the corners thereof for pivoting from a horizontal position flush with said deck plate members to a vertical position, said ears having apertures therein through which said wires are attached, the permanent deck defining the top of the hold section having apertures therein through which said ears extend when said deck plate members are in the uppermost position against the under side of the permanent deck, and pins insertable through said apertures in the portions of the ears projecting above the permanent deck for holding the deck plate members against the under side of the permanent deck.

6. A cargo loading apparatus as set forth in claim 1 in which said means for supporting and vertically moving said frame comprises a plurality of threaded rods extending through said hold section, a ring threaded on each rod engaged under said frame for supporting said frame, and motor means connected to said rods for rotating said rods for moving said rings up and down said rods for raising and lowering said frame member.

* * * * *